US011279541B2

(12) United States Patent
Bourgoin et al.

(10) Patent No.: US 11,279,541 B2
(45) Date of Patent: Mar. 22, 2022

(54) RESEALABLE CONTAINER WITH IMPROVED RECLOSABLE ADHESIVE LABEL

(71) Applicant: PHILIP MORRIS PRODUCTS S.A., Neuchatel (CH)

(72) Inventors: Philippe Bourgoin, Echallens (CH); Elke Rutzinger, Bergdietikon (CH)

(73) Assignee: Philip Morris Products S.A., Neuchatel (CH)

( * ) Notice: Subject to any disclaimer, the term of this patent is extended or adjusted under 35 U.S.C. 154(b) by 68 days.

(21) Appl. No.: 16/306,955

(22) PCT Filed: Jun. 27, 2017

(86) PCT No.: PCT/EP2017/065875
§ 371 (c)(1),
(2) Date: Dec. 4, 2018

(87) PCT Pub. No.: WO2018/002063
PCT Pub. Date: Jan. 4, 2018

(65) Prior Publication Data

US 2019/0144197 A1 May 16, 2019

(30) Foreign Application Priority Data

Jun. 30, 2016 (EP) ..... 16177360

(51) Int. Cl.
*B65D 75/58* (2006.01)
*B65D 85/10* (2006.01)

(52) U.S. Cl.
CPC ..... *B65D 75/5838* (2013.01); *B65D 85/1027* (2013.01); *B65D 85/10568* (2020.05)

(58) Field of Classification Search
USPC ..... 206/264, 265, 268, 271, 273
See application file for complete search history.

(56) References Cited

U.S. PATENT DOCUMENTS 8,783,454 B2 * 7/2014 Igo ..... G09F 23/00 206/242
9,394,085 B2 7/2016 Nakano
(Continued)

FOREIGN PATENT DOCUMENTS

CN 102076577 5/2011
CN 103813965 5/2014
(Continued)

OTHER PUBLICATIONS

PCT/EP2017/065875 Search Report and Written Opinion dated Jul. 20, 2017(10 pages).
(Continued)

*Primary Examiner* — Jacob K Ackun
(74) *Attorney, Agent, or Firm* — Mueting Raasch Group

(57) ABSTRACT

A resealable container for consumer goods comprises: a package of consumer goods with a cover portion partially separable from the remainder of the package to provide an access opening; and a reclosable adhesive label overlying the cover portion. The label comprises at least a bottom layer and a top layer. The bottom layer comprises a cut-out portion extending at least about the periphery of the cover portion and is affixed to the package by means of a permanent adhesive provided on a first area of the inner surface of the bottom layer extending about the periphery of the cover portion. The top layer is at least partly permanently affixed to the package by means of a first adhesive provided on a back hinge area of the package, and at least partly releasably affixed to the bottom layer by means of a second adhesive provided on a peeling area of the inner surface of the top layer extending distal from the hinge area and at least over a region of the cover portion. Thus, the top layer is movable from a closed position, wherein the top layer overlies at least the cut-out portion of the bottom layer, and an open position, wherein the top layer is lifted off the bottom layer. In
(Continued)

addition, a bottom layer height is less than a top layer height or a bottom layer width is less than a top layer width or both. Thus, the peeling area of the inner surface of the top layer extends at least partially beyond a periphery of the bottom layer to overlie the package.

14 Claims, 3 Drawing Sheets

(56) References Cited

U.S. PATENT DOCUMENTS

| | | | | |
|---|---|---|---|---|
| 9,499,331 | B2 | 11/2016 | De Oliveira | |
| 9,848,640 | B2 | 12/2017 | Pilzecker | |
| 10,377,548 | B2 * | 8/2019 | Bourgoin | B65D 85/1027 |
| 2008/0199109 | A1 | 8/2008 | Rutzinger | |
| 2009/0071852 | A1 * | 3/2009 | Negrini | B65D 85/1027 206/268 |
| 2011/0163100 | A1 | 7/2011 | Ueda | |
| 2014/0158690 | A1 | 6/2014 | Sumiyoshi | |
| 2015/0320111 | A1 | 11/2015 | Slooff | |
| 2016/0347537 | A1 * | 12/2016 | Lutzig | B65D 85/1045 |
| 2017/0152094 | A1 * | 6/2017 | Holford | B65B 61/18 |
| 2017/0275082 | A1 * | 9/2017 | Krasiev | B65D 75/5838 |
| 2018/0339846 | A1 * | 11/2018 | Eggen | B65D 75/5838 |
| 2018/0352853 | A1 * | 12/2018 | Besso | B65D 5/54 |
| 2018/0354695 | A1 * | 12/2018 | Bourgoin | B65D 75/5838 |
| 2018/0362247 | A1 * | 12/2018 | Slooff | B65D 85/1045 |
| 2019/0144197 | A1 * | 5/2019 | Bourgoin | B65D 85/1045 206/268 |
| 2019/0185252 | A1 * | 6/2019 | Hafker | B65B 19/228 |
| 2019/0218021 | A1 * | 7/2019 | Buse | B65B 61/065 |
| 2019/0270578 | A1 * | 9/2019 | Cailleaux | B32B 15/12 |
| 2019/0367235 | A1 * | 12/2019 | Holford | B65D 77/003 |
| 2020/0130912 | A1 * | 4/2020 | Collins | B65D 75/5855 |
| 2020/0180851 | A1 * | 6/2020 | Greco | B31B 50/88 |
| 2020/0180852 | A1 * | 6/2020 | Bellamah | B65D 5/4295 |
| 2020/0180853 | A1 * | 6/2020 | Henry | B65D 77/38 |
| 2020/0198877 | A1 * | 6/2020 | Mustafa | B65D 85/1045 |
| 2021/0032012 | A1 * | 2/2021 | Franzen | B65D 85/1081 |
| 2021/0032013 | A1 * | 2/2021 | Gibson | B65B 19/20 |

FOREIGN PATENT DOCUMENTS

| | | |
|---|---|---|
| CN | 104334470 | 2/2015 |
| EP | 1686060 | 8/2006 |
| GB | 2520992 | 6/2015 |
| JP | 11-268783 | 6/2005 |
| JP | 2013193791 | 9/2013 |
| JP | 2015-535515 | 6/2014 |
| JP | 2015-511911 | 4/2015 |
| JP | 2016-509981 | 4/2016 |
| WO | WO 2008/142540 | 11/2008 |
| WO | WO 2013/120915 | 8/2013 |
| WO | WO 2014/188357 | 11/2014 |
| WO | WO 2015/045070 | 4/2015 |
| WO | WO 2015/136510 | 9/2015 |
| WO | WO 2016/059077 | 4/2016 |
| WO | WO 2016/189108 | 12/2016 |

OTHER PUBLICATIONS

European Extended Search Report for Application No. 16177360.1 dated Nov. 30, 2016.

Office Action issued in China for Application No. 201780035413.5 dated Nov. 13, 2019 (15 pages). English translation included.

Office Action issued in Japan for Application No. 2018-563916 dated Apr. 28, 2021 (5 pages). English translation included.

* cited by examiner

RESEALABLE CONTAINER WITH IMPROVED RECLOSABLE ADHESIVE LABEL

This application is a U.S. National Stage Application of International Application No. PCT/EP2017/065875 filed Jun. 27, 2017, which was published in English on Jan. 4, 2018, as International Publication No. WO 2018/002063 A1. International Application No. PCT/EP2017/065875 claims priority to European Application No. 16177360.1 filed Jun. 30, 2016.

The present invention relates to a container for consumer goods comprising a reclosable adhesive label. In particular, the container of the present invention finds application as a container for elongate consumer good items, such as smoking articles.

Smoking articles are typically packaged in rigid hinge-lid containers. The bundle of smoking articles housed in the box is commonly wrapped in an inner liner, or package, of metallised paper, metal foil or other flexible sheet material. A sealed condition of the inner package is appreciated by consumers as proof that the goods inside the package are preserved in their original state at least until the first opening of the container.

Containers are known, for example from WO-A-2008/142540, wherein the smoking articles are enclosed in an inner package with an extraction opening removably closed by a cover flap that is releasably affixed to the inner package using non-dry adhesive applied to the underside of the cover flap. Such packages may be received in a hinge-lid container, the cover flap being glued permanently and non-removably to an inner surface of the front wall of the lid so that opening and closing of the lid simultaneously opens and closes the cover flap, thus revealing the extraction opening. WO 2016/059077 discloses a different resealable container, wherein the access opening in the package is covered by at least two layers of labelling web material. A first layer is applied directly onto the package by a first adhesive. The second layer is applied onto the first layer and is structured and functions substantially as a self-adhesive reclosable sticker adhesive label that can be removed from, and reattached to, the first layer several times.

Prior to being opened for the first time, such containers help preserve the moisture content of the consumer goods within the container under dry external conditions and may just as well protect the consumer goods against moisture uptake in tropical climates. However, in order to facilitate opening, the cover flap is affixed to the inner package by means of a low-strength, resealable adhesive and so, after repeated opening and re-closing of the cover flap, the sealing efficiency of one such cover flap may therefore decrease, to the point where, especially under extreme climates (for example, tropical climates or desert climates), it may become difficult to maintain the desired moisture content within the inner pack.

Some types of tobacco products are extremely sensitive to variations in their moisture content. Thus, a need is felt in the art to improve the moisture barrier properties of containers for consumer articles. Typically, variations in the range of plus or minus 5 percent, and sometimes even as low as plus or minus 1 percent, can impact the taste or performance of such tobacco products. Accordingly, a need is felt in the art to improve the moisture barrier properties of containers for consumer articles.

Several solutions have been proposed to meet such need, and yet, while the containers described above display improved moisture barrier properties prior to the first opening of the inner package, they do not fully address the issues associated with the use of the container under extreme weather conditions.

At the same time, it would be desirable to provide a resealable container that may generally be considered to be easy to open. Typically, it has been observed that where the force required for peeling a reclosable adhesive label off the surface of the package for the first time (when the opening force is maximum) is of about 18 Newtons or more, the container has been considered to be inconvenient to open. On the other hand, containers with an opening force at the first opening of 12 Newtons or less have generally been considered to be easy to open.

Thus, it would be desirable to provide a novel and improved resealable container for consumer goods such that a desirable moisture content of the goods within the container can be maintained both prior to the first opening of the inner package and during regular use of the container. Further, it would be desirable to provide an improved resealable container for consumer goods that is capable of preserving a desirable moisture content of the goods even when the container is exposed to extreme weather conditions. In addition, it would be desirable to provide one such resealable container for consumer goods that is easy to open, and preferably one that can easily be manufactured without requiring any major modification to existing equipment.

According to an aspect of the present invention there is provided a resealable container for consumer goods. The container comprises a package of consumer goods, the package comprising a cover portion delimited by lines of weakness such that the cover portion is partially separable from the remainder of the package to provide an access opening through which consumer goods can be removed. Further, the container comprises a reclosable adhesive label overlying the cover portion and extending beyond the periphery of the cover portion of the package. The reclosable adhesive label comprises at least a bottom layer and a top layer of label material, the bottom layer having a bottom layer height and a bottom layer width, the top layer having a top layer height and a top layer width. The bottom layer is affixed to the package by means of a first, permanent adhesive provided on a first area of the inner surface of the bottom layer extending about the periphery of the cover portion. Further, the bottom layer comprises a cut-out portion extending at least about the periphery of the cover portion of the package. The top layer is at least partly permanently affixed to the package by means of a first, permanent adhesive provided on a back hinge area of the inner surface of the top layer, and at least partly releasably affixed to the bottom layer by means of a second adhesive provided on a peeling area of the inner surface of the top layer extending distal from the hinge area and at least over a region of the cover portion, such that the top layer is movable from a closed position, wherein the top layer overlies at least the cut-out portion of the bottom layer, and an open position, wherein the top layer is lifted off the bottom layer. In addition, the bottom layer height is less than the top layer height or the bottom layer width is less than the top layer width or both, such that the peeling area of the inner surface of the top layer extends at least partially beyond a periphery of the bottom layer to overlie the package.

As used herein, the terms "front", "back", "upper", "lower", "top", "bottom" and "side", refer to the relative positions of portions of containers according to the invention and components thereof when the container is in an upright position with the lid of the outer housing in the closed position and the hinge line at the back of the container. When describing containers according to the present invention, these terms are used irrespective of the orientation of the container being described. The back wall of the hinge lid container housing is the wall comprising the hinge line. The access opening of the package is arranged in an upper portion of the package, such that the access opening extends at least partly across a top wall of the package. Where the whole of the access opening is formed in the top wall of the package, the front edge of the access opening is in a front portion of the top wall of the package. Where the access opening extends across the top wall and the front wall of the package, the front edge of the access opening is also the lower edge of the access opening and is located in a upper portion of the front wall of the package.

The top layer of the reclosable adhesive label may extend further towards the back of the container than the bottom layer of the reclosable adhesive label. The hinge area will thus be at the back of the top layer, and the top layer will be pivotable about said hinge such that the consumer can access the opening and the goods within the container from the front, when the top layer is moved from the closed position to the open position.

As an alternative, the top layer of the reclosable adhesive label may extend further towards one side than the bottom layer of the reclosable adhesive label. The hinge area will thus be on one side of the top layer, and the top layer will be pivotable about said hinge such that the consumer can access the opening and the goods within the container from one side, when the top layer is moved from the closed position to the open position.

The term "longitudinal" refers to a direction from bottom to top or vice versa. The term "transverse" refers to a direction perpendicular to the longitudinal direction.

The term "width" is used to describe the dimension of an element of a label or flap of a container as measured in the transverse direction. The term "height" is used to describe the dimension of an element of a label or flap of a container as measured in a direction perpendicular to the width of the element. The term "thickness is used the describe the dimension of an element of a label or flap of a container as measured in a direction perpendicular to both width and height of the element. When describing a label or elements of a label, reference is generally made to the label in a flat state.

Thus, when referring to a label or to an element of a label, such as a layer of a multi-layer label, the terms "width" and "height" are used to denote the dimensions of the label or element as measured along transverse and longitudinal axes defining a plane in which the flat label or element lies, whereas the term "thickness" denoted the dimension of the label or element as measured along an axis perpendicular to the plane in which the flat label or element lies.

The term "inner surface" is used throughout the specification to refer to the surface of a component of the assembled container that is facing towards the interior of the container, for example towards the consumer goods, when the container is in the closed position. Likewise, the term "outer surface" is used throughout the specification to refer to the surface of a component of the container that is facing towards the exterior of the container. For example, the reclosable adhesive label comprises an outer surface that, in some embodiments, is facing the outer hinge lid housing of the container and an inner surface that is facing the inside of the package and the consumer goods. It should be noted that the inside or outside surface is not necessarily equivalent to a certain side of a blank used in assembly of the container. Depending on how the blank is folded around the consumer goods, areas that are on the same side of the container can either face towards the inside or the towards the outside of the container.

The term "hinge line" refers to a line about which the lid may be pivoted in order to open the container. A hinge line may be, for example, a fold line or a score line in the panel forming the back wall of the container.

The term "line of weakness" is used herein to refer to a line along the laminar blank forming the package that has been mechanically deformed, for example by creasing, scoring, ablation, perforation or pre-cutting, such that a portion of the laminar blank at least partially delimited by the line of weakness can be easily partially separated from the remainder of the laminar blank, whilst remaining attached to the remainder of the laminar blank during use. By way of example, the lines of weakness may delimit the package portion of the sealing cover member on three sides, such that a rectangular flap is formed that can be partially separated from the remainder of the laminar blank. Thus, one such rectangular flap becomes free to pivot about a hinge line connecting the ends of the side lines of weakness. It will be understood that the package portion of the sealing cover member may be of different shapes and sizes.

In the present specification, the term "permanent adhesive" refers to a generally high tack adhesive capable of forming a reliable and secure connection between two substrates—for example, between the bottom layer of the reclosable adhesive label and the package of consumer goods—such that the two substrates can substantially not be separated during the normal and intended use of the container. In fact, separation of two substrates affixed to one another by means of a permanent adhesive would typically cause some undesirable damage (for example, tearing) to one or both substrates involved. The term "resealable adhesive" is used throughout the present specification to describe a generally low tack, removable adhesive capable of forming a moisture-resistant connection between two substrates—for example, between the top layer and the bottom layer of the reclosable adhesive label—such that the two substrates can be repeatedly separated and re-attached to one another without causing any damage to either substrate.

As used herein, the term "permanent adhesive" is meant to encompass also so-called "semi-permanent adhesive", that is, those adhesives that behave, at first, substantially like removable adhesives, such that two substrates affixed to one another by means of a semi-permanent adhesive may, during an initial period, be separated, whereas "semi-permanent adhesives" set over time to create an effectively permanent connection between the two substrates.

In general, the reclosable adhesive label and the cover portion of package may extend over the top wall of the package only, or over both top and front walls of the package. In some embodiments, the reclosable adhesive label or both reclosable adhesive label and cover portion may further partially extend over the back wall of the package. For example, the cover portion may extend substantially in its entirety over the top wall of the package, whereas the reclosable adhesive label may extend over the top wall and back wall of the package, the back hinge area of the top layer overlying a top portion of the outer surface of the back wall of the package. When describing the reclosable adhesive label or elements of the reclosable adhesive label or of the cover portion of the package, reference is generally made to the label or the cover portion in a flat state.

A resealable container in accordance with the present invention comprises a package of consumer goods, wherein the package is formed from a laminar blank and comprises a cover portion delimited by lines of weakness, such that the cover portion is partially separable from the remainder of the package. Thus, an access opening through which consumer goods can be removed is made available at the top of the package. Further, the container comprises a reclosable adhesive label overlying the cover portion and extending beyond the periphery of the cover portion of the package.

The reclosable adhesive label comprises at least a bottom layer and a top layer of label material. The bottom layer is affixed to the package by means of a first, permanent adhesive provided on a first area of the inner surface of the bottom layer extending about the periphery of the cover portion. In addition, the bottom layer comprises a cut-out portion at least partly aligned with the cover portion of the package.

In contrast to existing containers, in containers according to the present invention, the top layer is at least partly permanently affixed to the package by means of a first, permanent adhesive provided on a back hinge area of the inner surface of the top layer, and at least partly releasably affixed to the bottom layer by means of a second adhesive provided on a peeling area of the inner surface of the top layer extending distal from the hinge area and at least over a region of the cover portion. Thus, the top layer is movable from a closed position, wherein the top layer overlies at least the cover portion, and an open position, wherein the top layer is lifted off the bottom layer.

Further, the top layer and bottom layer are sized such that the peeling area of the inner surface of the top layer extends at least partially beyond a periphery of the bottom layer to overlie the package.

In resealable containers in accordance with the present invention, because the bottom layer is affixed to the package by means of a permanent adhesive during the manufacturing process, the bottom layer is firmly secured to the package and will not detach from the package during regular use of the container. At the same time, because the top layer is affixed directly to the package by means of permanent adhesive provided on the hinge area, a secure bond is ensured at all time between the top layer and the package. Accordingly, when the top layer is repeatedly detached from, and reattached to, the bottom layer during use, the connection between the top layer and the package is advantageously not impacted. Thus, resealable containers according to the present invention provide an improved protection against the uptake or loss of moisture for the consumer products within the container, both prior to and after the first opening of the container.

In resealable containers in accordance with the invention, the package with the reclosable adhesive label may be received in a hinge lid container and a connection may be provided between the reclosable adhesive label and the lid, such that movement of the lid between the closed and open positions causes the reclosable adhesive to also move between the respective closed and open positions. Thus, an access opening of the package may be made accessible "automatically" when the consumer opens the lid of the hinge lid container. In these embodiments, being able to ensure a solid bond between the top layer and the package is even more advantageous. Resealable containers according to the invention are easy to manufacture and do not require any extensive modification of the existing apparatus. As will be explained below, this is found, in particular, in preferred embodiments of the present invention, wherein the top layer is affixed to the bottom layer by the same permanent adhesive provided over the hinge area, and a layer comprising a release agent is provided over the whole surface of the bottom layer.

In its most general terms, a resealable container in accordance with the present invention comprises a package of consumer goods, the package comprising a cover portion delimited by lines of weakness such that the cover portion is partially separable from the remainder of the package to provide an access opening through which consumer goods can be removed. By way of example, the cover portion may be rectangular and be delimited on three sides by cut lines, such that the cover portion is pivotable about a back hinge line connecting the end of the side cut lines. However, the cover portion may have any other suitable shape.

Further, the container comprises a reclosable adhesive label overlying the cover portion and extending beyond the periphery of the cover portion of the package.

The reclosable adhesive label comprises at least a bottom layer and a top layer of label material, the bottom layer having a bottom layer height and a bottom layer width, the top layer having a top layer height and a top layer width. The bottom layer is affixed to the package by means of a first, permanent adhesive provided on a first area of the inner surface of the bottom layer extending about the periphery of the cover portion, the bottom layer comprising a cut-out portion extending at least about the periphery of the cover portion of the package. The cut-out portion may have different shapes, but preferably the shape of the cut-out portion substantially matches the shape of the cover portion. In some embodiments, the cut-out portion may have substantially the same shape of the cover portion, so that it is particularly easy for the cover portion to move through the cut-out portion.

The top layer is at least partly permanently affixed to the package by means of a first, permanent adhesive provided on a hinge area of the inner surface of the top layer, and at least partly releasably affixed to the bottom layer by means of a second adhesive provided on a peeling area of the inner surface of the top layer extending distal from the hinge area and over at least a region of the cover portion, such that the top layer is movable from a closed position, wherein the top layer overlies at least the access opening, and an open position, wherein the top layer is lifted off the bottom layer. The hinge area may be at the back of the top layer, such that a front portion of the top layer may pivot about the hinge area when the top layer is moved from the closed position to the open position. Thus, the consumer can access the opening and the goods within the package from the front of the package. As an alternative, the hinge area may be at one side of the top layer, such that the opposite side portion of the top layer may pivot about the hinge area when the top layer is moved from the closed position to the open position. Thus, the consumer can access the opening and the goods within the package from a side of the package.

Further, the bottom layer height is less than the top layer height or the bottom layer width is less than the top layer width or both, such that the peeling area of the inner surface of the top layer extends at least partially beyond a periphery of the bottom layer to overlie the package.

In some embodiments, the second adhesive may be a resealable adhesive.

Preferably, the second adhesive is a permanent adhesive and the resealable container further comprises a layer comprising a release agent provided between the bottom layer and the top layer, such that, in the closed position, the peeling area of the inner surface of the top layer at least partially overlies the layer of release agent.

In these embodiments, the combination of permanent adhesive on the inner surface of the top layer and release agent on the outer surface of the bottom layer is used, to an extent, to mimic the behaviour of a resealable adhesive. This provides an advantage over the use of a resealable adhesive, particularly during the manufacture of a reclosable adhesive label for use in a container in accordance with the present invention, in that the inner surface of the top layer can be entirely coated with permanent adhesive and the outer surface of the bottom layer can be entirely coated with the release agent. By contrast, if resealable adhesive is used, at least two different areas of the inner surface of the top layer need to be provided with different adhesives—namely, permanent adhesive on the hinge area and releasable adhesive on the peeling area.

The use of a permanent adhesive advantageously ensures that a stable bond is provided between the top layer and the cover portion of the package across the cut-out portion of the bottom layer. Thus, when the top layer is lifted off the bottom layer, the cover portion is also moved (for example, pivoted) away from the plane of the top wall of the package and the opening is made accessible for the user to extract consumer goods from the package. At the same time, the release agent provided between the top layer and the bottom layer makes it advantageously easy for the consumer to peel the top layer away from the bottom layer and to lift the cover portion away from the remainder of the package. Accordingly, containers in accordance with the present invention are generally perceived as easy to open.

The release agent may be any one several silicone-based release agents known to the skilled person. These include a wide variety of organopolysiloxanes, with a preference for high molecular weight silicone polymers or copolymers, such as polydimethylsiloxanes, epoxypolysiloxanes, and the like. Other suitable materials, such as low friction materials like polytetrafluoroethylene (PTFE) will be known to the skilled person and may find use as the release agent in containers according to the present invention.

In some embodiments, the release agent may be in the form of a printable composition. In general, the release agent may be in any form suitable for at least partly coating a surface of the top layer or bottom layer of the reclosable adhesive label.

Preferably, the layer comprising the release agent is applied on a first area of the outer surface of the bottom layer, and the front end portion of the peeling area of the inner surface of the top layer at least partially overlies the first area of the outer surface of the bottom layer. More preferably, the layer comprising the release agent covers continuously substantially the whole of the outer surface of the bottom layer.

In some embodiments, the layer comprising the release agent may be applied on the first area of the outer surface of the bottom layer by a printing process. This is advantageous in that it is easy to apply a finely controlled amount of release agent on the surface at specific locations on the surface of the bottom layer. However, especially in those embodiments where the layer comprising the release agent extends over substantially the whole of the outer surface of the bottom layer, such layer is preferably applied as a coating, which simplifies the manufacturing process.

In some embodiments, the first area of the outer surface of the bottom layer may comprise at least a first region and a second region, the second region being at the back of the first region. A release agent coverage in the first region is greater than a release agent coverage percentage in the second region. The expression "release agent coverage percentage" is used herein to describe the fraction or percentage of the surface area of a region of a surface of the reclosable adhesive label—for example, of the bottom layer of the reclosable adhesive label—that is coated or covered with the release agent. Where release agent is applied over the whole surface of a region, the release agent coverage percentage is 100. Where no release agent is applied within a region, the release agent coverage percentage is 0.

By way of example, the release agent may be applied on a region of a surface of the reclosable adhesive label in a non-continuous repeating pattern. The non-continuous repeating pattern may comprise a plurality of spaced apart rows, such as linear rows, non-linear rows, wavy rows, zigzag rows, and combinations thereof. As an alternative or in addition, regularly spaced apart dots or islands of release agent may be applied. In some embodiments, the islands of release agent may have the shape of type fonts. The expression "regularly spaced apart" connotes that the distance between each dot and its neighbouring dots is substantially constant over the region. As will be understood, this can be conveniently achieved when the release agent is applied by means of a printing operation. Thus, release agent coverages ranging from 0 to 100 can advantageously be provided in the first region and the second region. For example, by applying the release agent according to a suitable pattern, 50 percent of the surface of the region can be covered with the release agent.

In the first region, the release agent coverage percentage is preferably at least about 65 percent, more preferably at least about 70 percent. In addition, or as an alternative, the release agent coverage percentage in the first region is preferably less than about 95 percent, more preferably less than about 90 percent.

In the second region, the release agent coverage percentage is preferably at least about 50 percent, more preferably at least about 60 percent. In addition, or as an alternative, the release agent coverage percentage in the second region is preferably less than about 90 percent, more preferably less than about 80 percent.

In general, peeling the top layer off a region of the bottom layer with a greater release agent coverage percentage will be easier than peeling off the top layer off a region of the bottom layer having a smaller release agent coverage percentage.

In resealable containers, it has been observed that the peel force is highest when the consumer begins to detach the label from the underlying substrate, and subsequently oscillates between local maxima and minima. The initial peak peel force has been observed to be the absolute maximum, and is generally significantly higher than the local maxima encountered subsequently. In containers according to the present invention, wherein different regions of the surface of the bottom layer have different release agent coverage percentages, it is possible to finely tune the force required from peeling the top layer off different regions of the inner layer, such that, for example, it is particularly easy for the consumer to begin to detach the top layer from the bottom layer. Without wishing to be bound to theory, this corresponds to a significant reduction of the initial peak peel force described above, which is very advantageous in that it provides the consumer the desirable perception of a particularly easy-to-open container.

At the same time, it is possible to ensure that the resistance to peeling gradually increases as the top layer is progressively moved away from the closed position to expose the access opening of the package. This advantageously provides a desirable balance between ease of opening of the package and the need for enough adhesion between the top layer and the bottom layer for sealing and re-sealing purposes.

The first region and the second region may have any suitable shape. In some preferred embodiments, the first region and the second region are substantially rectangular. Even more preferably, the first region and the second region extend transversely across the whole width of the bottom layer, such as to define bands on the outer surface of the bottom layer.

The first region and the second region may be substantially adjacent to one another. As an alternative, the first region and the second region may be at a distance from one another with reference to a direction perpendicular to the width of the bottom layer. In some preferred embodiments, the first region and the second region define adjacent transverse bands extending transversely across the whole width of the bottom layer.

Preferably, a back edge of the top layer extends past a back edge of the bottom layer, such that a back region of the peeling area of the inner surface of the top layer overlies the package. In practice, an overall height of the top layer is greater than an overall height of the bottom layer, the back edges of the top layer and the bottom layer being essentially aligned. More preferably, a distance between the back edge of the top layer and the back edge of the bottom layer is at least about 1 millimetre. Even more preferably, a distance between the back edge of the top layer and the back edge of the bottom layer is at least about 1.5 millimetres. In addition, or as an alternative, a distance between the back edge of the top layer and the back edge of the bottom layer is preferably less than about 8 millimetres. More preferably, a distance between the back edge of the top layer and the back edge of the bottom layer is less than about 5 millimetres. In preferred embodiments, a distance between the back edge of the top layer and the back edge of the bottom layer is from about 1 millimetre to about 8 millimetres, more preferably from 1.5 millimetres to about 5 millimetres.

In addition, or as an alternative, at least a side edge of the top layer preferably extends past a side edge of the bottom layer, such that a side region of the peeling area of the inner surface of the top layer overlies the package. In practice, a width of the top layer is (at least locally) greater than a width of the bottom layer. As an alternative, both height and width of the top layer may be greater than the height and width of the bottom layer. More preferably, a distance between the side edge of the top layer and the side edge of the bottom layer is at least about 1 millimetre. Even more preferably, a distance between the side edge of the top layer and the side edge of the bottom layer is at least about 1.5 millimetres. In addition, or as an alternative, a distance between the side edge of the top layer and the side edge of the bottom layer is preferably less than about 8 millimetres. More preferably, a distance between the side edge of the top layer and the side edge of the bottom layer is less than about 5 millimetres. In preferred embodiments, a distance between the side edge of the top layer and the side edge of the bottom layer is from about 1 millimetre to about 8 millimetres, more preferably from 1.5 millimetres to about 5 millimetres.

In some embodiments, the bottom layer comprises a body portion having substantially the same width as a width of an overlying body portion of the top layer; and a front portion extending distal from the body portion and having a width less than a width of an overlying front portion of the top layer. Preferably, a width of a front edge of the bottom layer is less than a width of a front edge of the top layer.

Preferably, a front area of the inner surface of the top layer is substantially free of adhesive. More preferably, one such adhesive-free front area of the inner surface of the top layer overlies the layer of release agent. Thus, a front portion of the top layer is provided that is effectively not affixed to the bottom layer and which can, accordingly, be easily used by the consumer to peel the remainder of the top layer off the bottom layer.

In some embodiments, the reclosable adhesive label comprises a plurality of crease lines extending transversely across the reclosable adhesive label. Preferably, the crease lines are formed on the inner surface of the top layer. In addition, or as an alternative, the cover portion comprises a plurality of crease lines extending transversely across the cover portion. Preferably, the crease lines are formed on the inner surface of the cover portion.

Without wishing to be bound to theory, it is understood that the crease lines in the adhesive label or the cover portion reduce the structural strength of the material from which the adhesive label or the cover portion or both are formed, and so effectively increase the pliability of the adhesive label or the cover portion or both. This is advantageous in that the adhesive label or the cover portion or both can more easily bend during opening and closing.

Regardless of their specific arrangement in the cover portion or adhesive label, the presence of the crease lines is advantageous in that they make it is easier for the consumer to gradually detach the top layer of the label from the bottom layer of the label to make the opening accessible without causing any significant deformation or any damage to the package. Further, in embodiments where the package is received in a hinge lid container and an end of the top layer is affixed to a surface of the lid, such that movement of the lid between respective open and closed positions causes a corresponding movement of the top layer between the respective open and closed positions, the crease lines advantageously make it possible for the top layer to assume a desirable S-shape when the lid is brought into the open position.

Preferably, the first, permanent adhesive and the second adhesive are the same adhesive. This is advantageous in that it simplifies the manufacturing process.

A package in accordance with the invention as set out above may be received in the box of a hinge lid container. In some preferred embodiments, wherein the hinge area is a back end area of the inner surface of the top layer, an end of the top layer is permanently affixed to an inner surface of the lid, such that upon opening the lid the top layer is moved from the closed position towards the open position to at least partly expose the access opening. In some embodiments, the end of the top layer is affixed to the inner surface of a front wall of the lid. As an alternative, the end of the top layer may be affixed to the inner surface of a top wall of the lid.

Preferably, the package is formed of metal foil or metallised paper. The package material may be formed as a laminate of a metallised polyethylene film, and a liner material. The liner material may be a supercalendered glassine paper. In addition, the package material may be provided with a print-receptive top coating.

The hinge lid container may be formed from a blank of any suitable material or combination of materials, including, but not limited to, cardboard, paperboard, plastic, metal, or combinations thereof. Preferably, the blank is a laminar cardboard blank having a weight of between about 100 grams per square metre and about 350 grams per square metre.

The hinge-lid container may optionally comprise an outer wrapper, which is preferably a transparent polymeric film of, for example, high or low density polyethylene, polypropylene, oriented polypropylene, polyvinylidene chloride, cellulose film, or combinations thereof and the outer wrapper is applied in a conventional manner. The outer wrapper may include a tear tape. In addition, the outer wrapper may be printed with images, consumer information or other data.

Suitable materials for the layers of the reclosable adhesive label will be known to the skilled person. Examples include thermoplastic materials such as polypropylene, polyethylene terephthalate, polyethylene. In a preferred embodiment, the bottom layer comprises polypropylene and the top layer comprises polyethylene terephthalate. In some embodiments, the top layer is thicker than the bottom layer.

Several resealable, semi-permanent and permanent adhesives suitable for use in a container according to the present invention are commercially available and will be known to the skilled person.

The package, as well as the outer hinge lid container, is preferably a rectangular parallelepiped comprising two wider walls spaced apart by two narrower walls.

Hinge lid containers according to the invention may be in the shape of a rectangular parallelepiped, with right-angled longitudinal and right-angled transverse edges. Alternatively, the hinge lid container may comprise one or more rounded longitudinal edges, rounded transverse edges, bevelled longitudinal edges or bevelled transverse edges, or combinations thereof. For example, the hinge lid outer container may comprise, without limitation:

- One or two longitudinal rounded edges on the front wall, and/or one or two longitudinal rounded or bevelled edges on the back wall.
- One or two transverse rounded edges on the front wall, and/or one or two transverse rounded or bevelled edges on the back wall.
- One longitudinal rounded edge and one longitudinal bevelled edge on the front wall, and/or one transverse rounded edge and one transverse bevelled edge on the back wall.
- One or two transverse rounded or bevelled edges on the front wall and one or two longitudinal rounded or bevelled edges on the front wall.
- Two longitudinal rounded or bevelled edges on a first side wall or two transverse rounded or bevelled edges on the second side wall.

Containers according to the invention find particular application as containers for elongate smoking articles such as, for example, cigarettes, cigars or cigarillos. It will be appreciated that through appropriate choices of the dimensions thereof, containers according to the invention may be designed for different numbers of conventional size, king size, super-king size, slim or super-slim cigarettes. Alternatively, other consumer goods may be housed inside the container.

Through an appropriate choice of the dimensions, containers according to the invention may be designed to hold different total numbers of smoking articles, or different arrangements of smoking articles. For example, through an appropriate choice of the dimensions, containers according to the invention may be designed to hold a total of between ten and thirty smoking articles. The smoking articles may be arranged in different collations, depending on the total number of smoking articles.

The invention will now be further described, by way of example only, with reference to the accompanying drawings in which.

Figure 1:
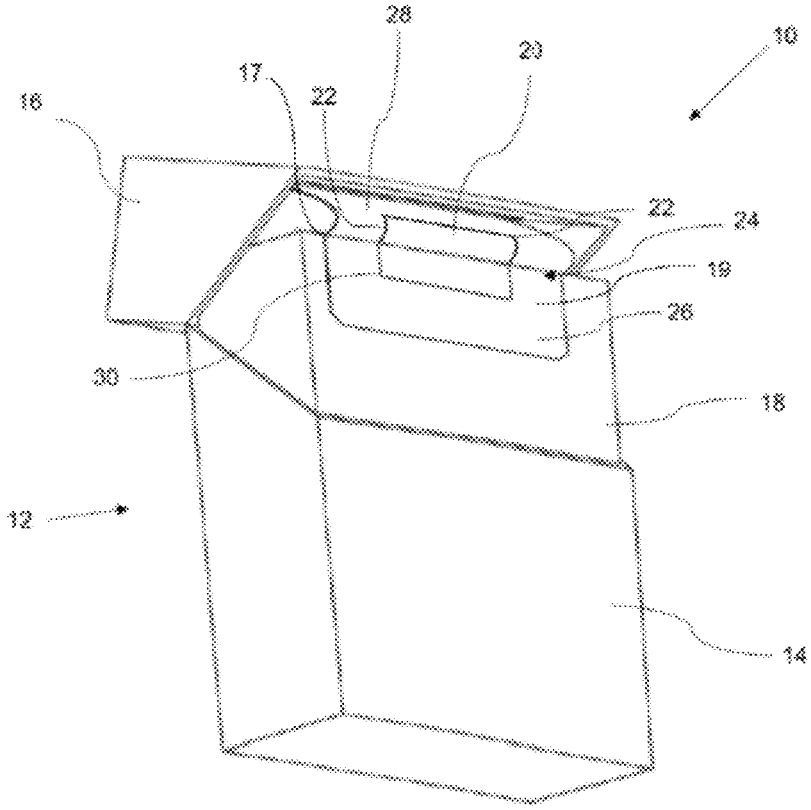
FIG. 1 is a schematic perspective view of a container in accordance with the present invention.
Figure 3:
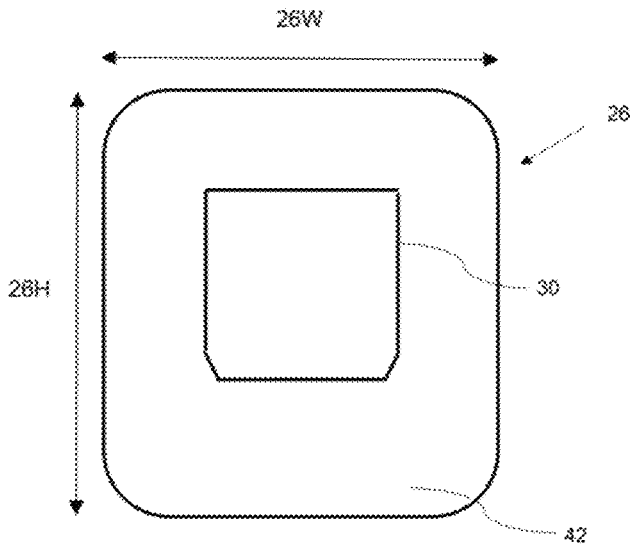
FIG. 3 is a schematic top view of the outer surface of the bottom layer of the label of the container of FIG. 1.

FIG. 1 shows a container 10 in accordance with the present invention. The container 10 comprises an outer housing 12 which is a rectangular parallelepiped and includes a box 14 and a lid 16. The lid 16 is hinged about a hinge line extending across a back wall of the housing 12 and is pivotable between an open position (as illustrated in FIG. 1) and a closed position (not shown). Further, the container 10 comprises an inner package 18 of smoking articles housed in the box 14. The inner package 18 comprises a cover portion 20 delimited by lines of weakness 22 such that the cover portion 20 is partially separable from the remainder of the package to provide an access opening through which consumer goods can be removed. In the embodiment of FIGS. 1 and 3, the cover portion 20 extends across the top wall 17 and the front wall 19 of the inner package 18. The smoking articles contained in the inner package 18 can be removed through the access opening when the lid 16 is in the open position.

Figure 4:
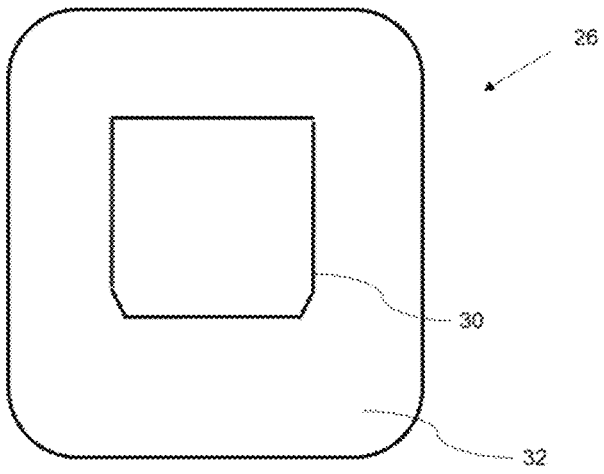
FIG. 4 is a schematic top view of the inner surface of the bottom layer of the label of the container of FIG. 1.

The container 10 further comprises a reclosable adhesive label 24 extending beyond the periphery of the cover portion 20 of the inner package 18. As illustrated in more detail in FIG. 4, the reclosable adhesive label 24 comprises at least a bottom layer 26 and a top layer 28. The bottom layer 26 comprises polypropylene and has a thickness of about 30 micrometres. The top layer 28 comprises polyethylene terephthalate and has a thickness of about 50 micrometres.

The reclosable adhesive label 24 comprises a plurality of crease lines 27 extending transversely across the reclosable adhesive label 24. The crease lines 27 are formed on the inner surface of the top layer 28. The cover portion 20 comprises a plurality of crease lines 27*a* extending transversely across the cover portion 20. Preferably, the crease lines 27*a* are formed on the inner surface of the cover portion 20.

Figure 2:
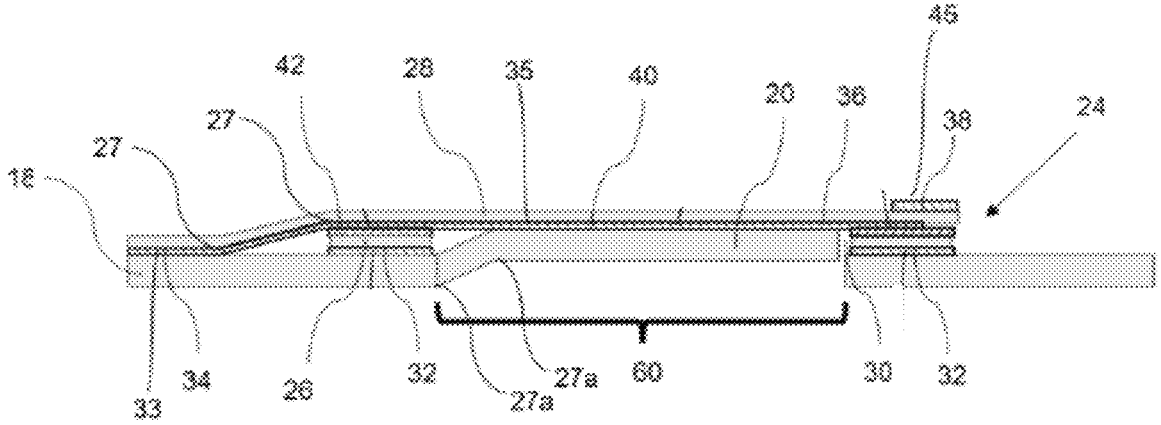
FIG. 2 is a schematic sectional view of a cover portion and reclosable adhesive label in a closed position.

The bottom layer 26 comprises a cut-out portion 30 at least partially aligned with the cover portion 20 of the inner package 18 and is affixed to the inner package 18 by means of a first, permanent adhesive provided on a first area 32 of the inner surface of the bottom layer 26 (see FIGS. 2 and 4) extending about the periphery of the cover portion 20.

Figure 6:
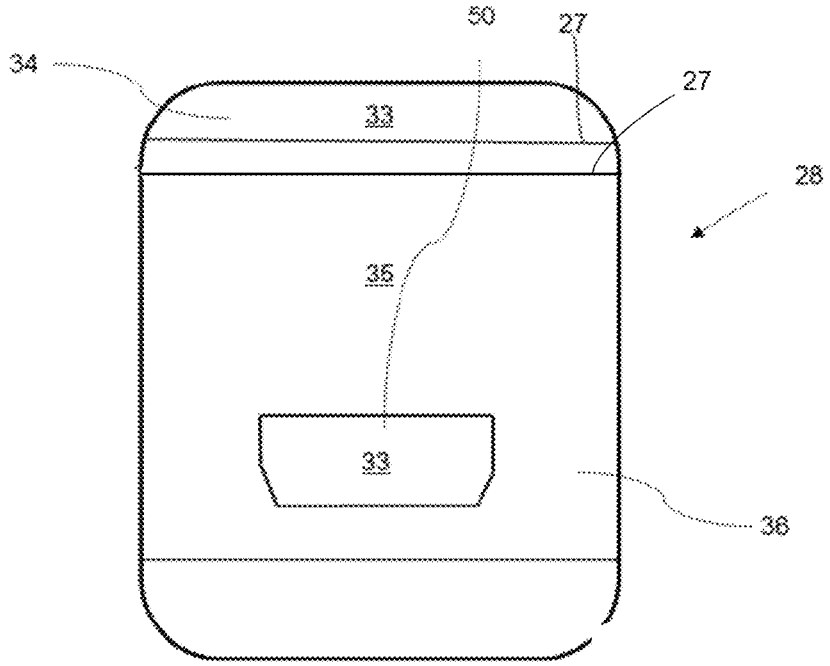
FIG. 6 is a schematic top view of the inner surface of the top layer of the label of the container of FIG. 1.

The top layer 28 is at least partly permanently affixed to the inner package 18 by means of a first, permanent adhesive 33 provided on a back hinge area 34 of the inner surface of the top layer 28 (see FIGS. 2 and 6) and at least over a region 50 of the inner surface of the top layer overlying directly the cover portion 20.

In addition, the top layer 28 is partly releasably affixed to the bottom layer 26 by means of a second adhesive 35 provided on a peeling area 36 of the inner surface of the top layer extending distal from the back hinge area 34 and at least over a region of the cover portion 20. Thus, the top layer 28 is movable between a closed position, wherein the top layer 28 overlies at least the cut-out portion 30, and an open position, wherein the top layer 28 is lifted off the bottom layer 24, which also causes the cover portion 20 to be moved away from the remainder of the inner package 18 to make the opening 60 accessible by the consumer.

Figure 5:
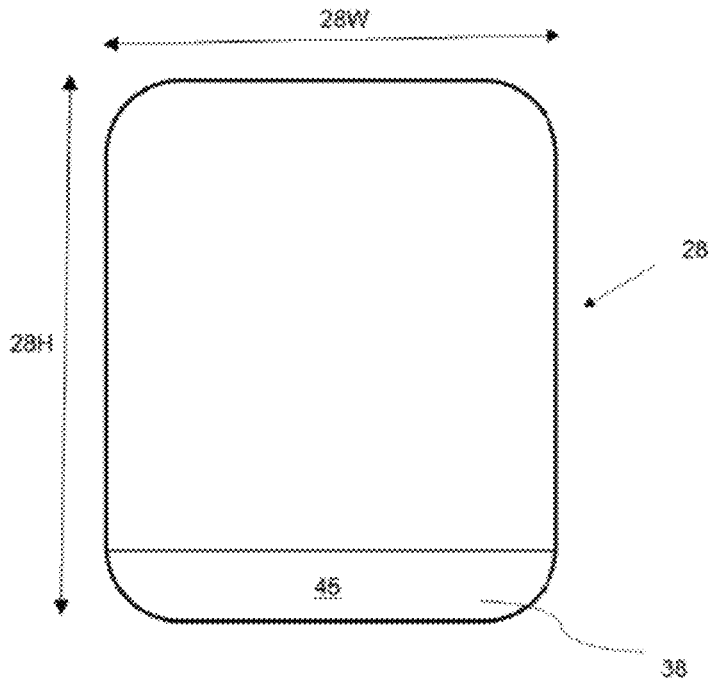
FIG. 5 is a schematic top view of the outer surface of the top layer of the label of the container of FIG. 1.

The second adhesive is a permanent adhesive. The top layer 28 is also permanently affixed to an inner surface of the lid 16 by means of adhesive 45 provided on a front edge portion 38 of the outer surface of the top layer 28 (see FIGS. 2 and 5), such that upon opening the lid 16 the top layer 28 of the reclosable adhesive label 24 is moved from the closed position towards the open position to lift the cover portion 20 and make the opening 60 in the package accessible.

In addition, the resealable container 10 comprises a layer 40 comprising a silicone based release agent provided between the bottom layer 26 and the top layer 28, such that, in the closed position, a front end portion of the peeling area 36 of the inner surface of the top layer 28 at least partially overlies the layer 40 comprising the release agent. In more detail, the layer 40 comprising the release agent is applied by printing on a first area 42 of the outer surface of the bottom layer 26 (see FIGS. 2 and 3), the front end portion of the peeling area 36 of the inner surface of the top layer 28 at least partially overlying the first area 42 of the outer surface of the bottom layer 26.

A height 26H of the bottom layer 26 is less than a height 28H of the top layer 28. In more detail, a back edge of the top layer extends past a back edge of the bottom layer. Thus, a portion of the peeling area 36 of the inner surface of the top layer 28 overlies the inner package 18.

A width 26W of the bottom layer 26 is also less than a width 28W of the top layer 28.

The invention claimed is:

1. A hinge lid container for consumer goods, comprising:

a box;

a lid hinged to the box along a hinge line extending across a back wall of the container; and a resealable package located within the box for receiving consumer goods, the package comprising:

a cover portion delimited by lines of weakness such that the cover portion is partially separable from the remainder of the package to provide an access opening through which consumer goods can be removed; and a reclosable adhesive label overlying the cover portion and extending beyond the periphery of the cover portion of the package, wherein the reclosable adhesive label comprises at least a bottom layer and a top layer of label material, the bottom layer having a bottom layer height and a bottom layer width, the top layer having a top layer height and a top layer width;

the bottom layer being affixed to the package by means of a first, permanent adhesive provided on at least a portion of the inner surface of the bottom layer extending about the periphery of the cover portion, the bottom layer comprising a cut-out portion extending at least about the periphery of the cover portion of the package; and the top layer being at least partly permanently affixed to the package by means of a second, permanent adhesive provided on at least a portion of a hinge area of the inner surface of the top layer, and at least partly releasably affixed to the bottom layer by means of a third adhesive provided on at least a portion of the inner surface of the top layer extending distal from the hinge area and over at least a portion of the cover portion, such that the top layer is movable from a closed position, wherein the top layer overlies at least the cut-out portion of the bottom layer, and an open position, wherein the top layer is lifted off the bottom layer to reveal the cut-out portion;

wherein the hinge area is located at a back end of the reclosable adhesive label such that edges of the top and bottom layers closest to the hinge area are respective back edges of the top and bottom layers;

wherein the bottom layer height is less than the top layer height, such that the back edge of the top layer extends past the back edge of the bottom layer, such that the inner surface of the top layer directly overlies the package.

2. A hinge lid container according to claim 1, wherein the third adhesive is a permanent adhesive and the resealable package further comprises a layer comprising a release agent provided between the bottom layer and the top layer, such that, in the closed position, the inner surface of the top layer at least partially overlies the layer of release agent.

3. A hinge lid container according to claim 2, wherein the layer comprising the release agent is applied on at least a portion of the outer surface of the bottom layer.

4. A hinge lid container according to claim 3, wherein the layer comprising the release agent covers the outer surface of the bottom layer.

5. A hinge lid container according to claim 1, wherein a distance between the front edge of the top layer and the front edge of the bottom layer is at least about 1 millimetre.

6. A hinge lid container according to claim 1, wherein at least a side edge of the top layer extends past a side edge of the bottom layer, such that a side region of the inner surface of the top layer overlies the package.

7. A hinge lid container according to claim 6, wherein a distance between the side edge of the top layer and the side edge of the bottom layer is at least about 1 millimetre.

8. A hinge lid container according to claim 6, wherein the bottom layer has a first width substantially the same as a width of the overlying top layer and a second width distal from the first width, the second width being less than a width of the overlying top layer.

9. A hinge lid container according to claim 8, wherein a width of a front edge of the bottom layer is less than a width of a front edge of the top layer.

10. A hinge lid container according to claim 1, wherein the reclosable adhesive label comprises a plurality of crease lines extending transversely across the reclosable adhesive label.

11. A hinge lid container according to claim 1, wherein the cover portion comprises a plurality of crease lines extending transversely across the cover portion.

12. A hinge lid container according to claim 1, wherein the second, permanent adhesive and the third adhesive are the same adhesive.

13. A hinge lid container according to claim 1, wherein the hinge area is the back end area of the inner surface of the top layer and a front edge portion of the top layer of the reclosable adhesive label is permanently affixed to an inner surface of the lid, such that upon opening the lid the top layer is moved from the closed position towards the open position to at least partly expose the cut-out portion.

14. A hinge lid container according to claim 1, wherein the resealable package has dimensions configured to receive smoking articles.

* * * * *